United States Patent [19]

Konishi et al.

[11] 4,018,049

[45] Apr. 19, 1977

[54] EXHAUST MANIFOLD REACTOR ASSEMBLY

[75] Inventors: Masami Konishi; Kazumasa Futamura, both of Toyota, Japan

[73] Assignee: Toyota Jidosha Kogyo Kabushiki Kaisha, Japan

[22] Filed: Dec. 12, 1975

[21] Appl. No.: 640,185

[30] Foreign Application Priority Data

July 22, 1975 Japan ..... 50-88872

[52] U.S. Cl. ..... 60/282; 60/322; 60/323

[51] Int. Cl.[2] ..... F01N 3/10

[58] Field of Search ..... 60/282, 322, 323

[56] References Cited

UNITED STATES PATENTS

| | | | |
|---|---|---|---|
| 3,703,083 | 11/1972 | Tadokoro | 60/282 |
| 3,722,221 | 3/1973 | Chopin | 60/322 |

*Primary Examiner*—Douglas Hart
*Attorney, Agent, or Firm*—Toren, McGeady and Stanger

[57] ABSTRACT

An exhaust manifold reactor assembly usable for reducing noxious emissions from the exhaust system of an internal combustion engine includes a reactor casing having a generally longitudinal cylindrical shape in flow communication between the exhaust port of the engine and the exhaust pipe of the exhaust system. An internal concentric core of similar shape is fixedly connected to the reactor casing at the midpoint of its length, and a second connection enabling longitudinal sliding engagement between the core and the casing is provided at another location off-center from the casing midpoint.

9 Claims, 6 Drawing Figures

EXHAUST MANIFOLD REACTOR ASSEMBLY

BACKGROUND OF THE INVENTION

The present invention relates generally to an exhaust manifold reactor assembly for the exhaust system of an internal combustion engine and more specifically to an assembly which comprises a cylindrical reactor casing having an internal concentric core mounted therein. The invention is particularly concerned with the arrangement for mounting the core.

Generally speaking, a manifold reactor is used to eliminate through oxidation the noxious contents (for example, hydrocarbons or carbon monoxide) which might otherwise be contained in the exhaust gases of an internal combustion engine. In order to effect the oxidation of the noxious contents, the manifold reactor is equipped with a recombustion chamber whose temperature is maintained as high as possible. For this purpose, an insulating material is disposed on the outer periphery of the recombustion chamber to thereby minimize heat emission from the recombustion chamber.

Since the core defining the recombustion chamber is exposed to such a high temperature whereas the reactor casing supporting the core has a relatively low temperature, it is generally difficult to effect fixed connection between the core and the reactor casing in plural positions. This is because thermal expansion having different values between the reactor casing and the core occurs.

Therefore, the conventional connection between the reactor casing and the core of the manifold reactor has been accomplished fixedly in one longitudinally central position. In another position, however, the connection is accomplished such that the projections formed on the reactor casing are made to abut against the core.

However, support of the core by such connections is not sufficient for protecting the manifold reactor from vibrations from the internal combustion engine or the like. Fixed contact between the reactor casing and the core invites vibrations in the core, which in turn results in breakage and dislocation of the insulating material. This may further result in breakage of the core itself. These undesirable phenomena are promoted by the thermal expansion of the core. As a result, the conventional manifold reactor does not exhibit a sufficiently long service life.

It is, therefore, an object of the present invention to provide an exhaust manifold reactor assembly which is free from the above-described disadvantages and which can enjoy prolonged life and stable operation.

Another object of the present invention is to provide an exhaust manifold reactor assembly which exhibits substantially reduced noise levels.

SUMMARY OF THE INVENTION

Briefly, the present invention may be described as a reactor assembly in flow communication between the exhaust ports of an internal combustion engine and the exhaust pipe of the engine exhaust system. The assembly includes an outer cylindrical casing, an inner concentric core and insulation between the core and the casing. The invention is particularly concerned with an arrangement for mounting the core within the casing which includes a first mounting means fixedly connecting the core to the casing at the longitudinal midpoint of the casing and a second mounting means which secures the core to the casing at a point off-center from the casing longitudinal midpoint and which permits relative sliding engagement between the core and the casing in longitudinal directions thereof.

With this construction, the exhaust manifold reactor assembly according to the present invention cannot only accomplish stable operation for a prolonged time period but will also reduce noise which might otherwise be produced from the reactor assembly due to abutments between the core and the reactor casing.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
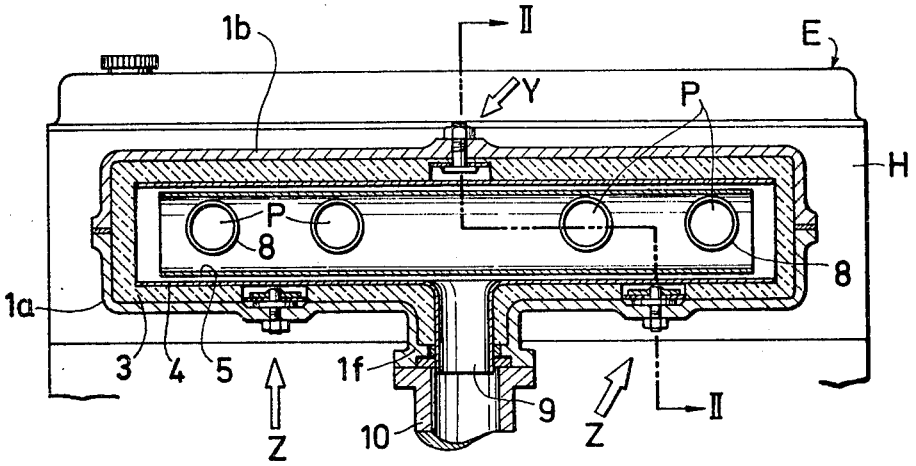
FIG. 1 is a longitudinal sectional view showing an exhaust manifold reactor assembly according to the present invention.
Figure 2:
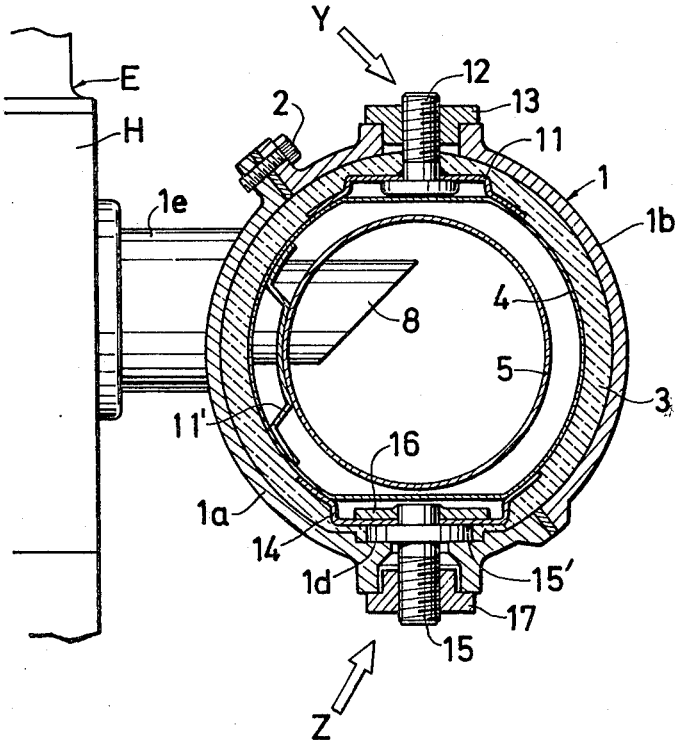
FIG. 2 is a sectional view taken along the line II—II of the reactor assembly of FIG. 1.

Referring now to the drawings, wherein like reference numerals are used for similar parts throughout the various figures thereof, a reactor casing 1 of an exhaust manifold reactor assembly, as shown in FIGS. 1 and 2, is composed of two semicircular halves 1*a* and 1*b*, which are connected to each other by means of a bolt 2. The reactor assembly has an inlet pipe 1*e* attached to a cylinder head H of an internal combustion engine E and an outlet pipe 1*f* connected to an exhaust pipe 10 of the engine E.

Within the reactor casing 1, there are disposed outer and inner cores 4 and 5, which are made of thin material plate, for instance, stainless steel and which are arranged substantially concentrically with respect to the reactor casing 1. These cores 4 and 5 define a recombustion chamber.

The exhaust gases discharged from an exhaust port P of the internal combustion engine E are introduced into the inner core 5 by way of an inlet port liner 8 which is disposed in the reactor inlet pipe 1*e*. These exhaust gases are then allowed to flow about the two open end portions of the inner core 5 to the space between the inner and outer cores 5 and 4, and further through an outlet port liner 9, which is connected to the outer core 4, to the exhaust pipe 10 which is connected to the outlet pipe 1*f*.

Between the reactor casing 1 and the outer core 4, there is interposed an insulating material 3 which is made of, for example, ceramic fibers.

The outer core 4 is connected to the reactor casing 1 at locations Y and Z, as is apparent from FIG. 1. The outer core 4 is, on the other hand, fixedly welded to the inner core 5 at the above locations and at another suitable location by means of support members 11'.

The connections between the outer core 4 and the reactor casing 1 are accomplished by means of bolts 12 and 15, and nuts 13 and 17. These connecting bolts 12 and 15 are attached at the core side to the cores by welding by means of support members 11 and 14. On the other hand, the nuts 13 and 17 to be brought into contact with the reactor casing 1 are welded to the reactor casing after assembly. Thus, these nuts 13 and 17 are produced as flanged nuts.

Because of this construction it is possible not only to maintain hermetic sealing between the nuts and the casing but also to apply a suitable initial stress to the outer core 4 through the support members 11 and 14 by fastening the nuts 13 and 17. The reason why the initial stress is applied is to soften the thermal stress which is generated upon thermal expansion of the core 4. By fastening of the nuts, moreover, the core 4 is integrally supported on the reactor casing 1 so that it can be made free from separation or vibration.

The support member 11 is welded in the position Y to the head of the bolt 12, which is at this point made to pass through a bore of the support member 11.

Figure 3:
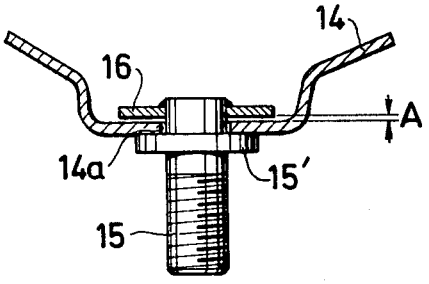
FIG. 3 is an enlarged sectional view showing a support member and a bolt by enlarging a portion of FIG. 2.
Figure 4:
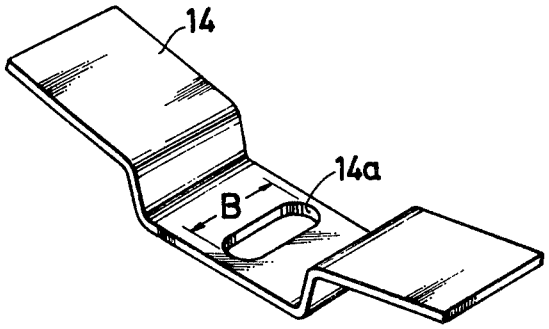
FIG. 4 is a perspective view showing the support member.

The support member 14 and the bolt 15 in the position Z are shown in FIGS. 3 and 4. This support member 14 is formed with a slot 14*a* having a length B. The core and the reactor casing can move relative to each other to an extent determined by the difference between the length B and the diameter of the bolt 15. The bolt 15 formed with a flange 15' is made to pass through the slot 14*a*, and then its flange 16 is welded to the bolt 15. The bolt 15 used in this instance is formed at its head with the two flanges 15' and 16' and the flange 15' is made integral with the bolt 15 while the flange 16 is welded to the bolt, in the embodiment shown. However, these two flanges can be welded to the bolt 15, if desired. The support member 14 is interposed between the two flanges, and its bore 14*a*, through which the bolt 15 is made to pass, is formed into a slot. The longitudinal direction of this slot is oriented in the longitudinal direction of the core. Since, moreover, the spacing between the two flanges is larger than the thickness of the support member 14 by a value A (which is nearly equal to zero.), the support member 14 in the position Z is allowed to expand in the longitudinal direction together with the core 4 with respect to the fixed support position Y upon thermal expansion of the core 4, but no resulting expansion stress is applied to the bolt 15 because of the fact that the value of the spacing A is maintained and that the support member 14 has the slot 14*a*. On the other hand, the nuts 13 and 17 are welded to the reactor casing 1 so as to prevent the core as a whole from floating as a result of the thermal expansion of the outer core 4 in the radial direction. Accordingly, no thermal expansion is established in the core, and no vibration from the engine is transmitted to the core.

In order to ensure the sliding movement in the longitudinal direction of the reactor assembly, stable maintenance of the spacing A should be accomplished even upon fastening of the nut 17. For this purpose, a seat 1*d* is formed in an inner face of the reactor casing 1 in the range of the bore formed in the reactor casing, and the fastening force of the nut 17 can be dispersed through the flange face 15' of the bolt 15 from the seal 1*d* of the reactor casing 1 by bringing the flange 15' of the bolt 15 into abutment engagement with the particular seat 1*d*. Since, therefore, no fastening stress is transmitted to the flange 16 by this fastening force, the flange face can be free from warpage, so that the initial spacing A can be stably maintained, thus ensuring the sliding function.

As a result, it is possible to establish the fixed connection between the reactor casing and the core at the location Y and to establish slidable connection in the longitudinal direction of the reactor assembly at the location Z.

Figure 5:
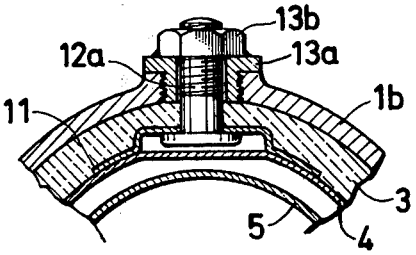
FIGS. 5 and 6 are enlarged sectional views showing other constructions of the connection between the reactor casing and the core.
Figure 6:
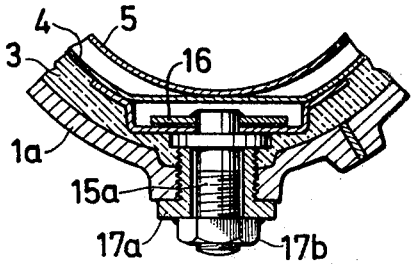

Another embodiment of connection or mounting means between the reactor casing and the core is exemplified in FIGS. 5 and 6. In this second embodiment, if nuts 13*b* and 17*b* cannot be welded directly to the reactor casing 1, inserts 13*a* and 17*a* are screwed into the reactor casing, and corresponding nuts are welded to these inserts. The inserts are formed into a flanged cylinder, the outer periphery of which is formed with such external threads as are engageable with the internal threads formed in the bore of the reactor casing. In the shown embodiment, the fastened nuts 13*b* and 17*b* are also welded into bolts 12*a* and 15*a*, respectively.

While specific embodiments of the invention have been shown and described in detail to illustrate the application of the inventive principles, it will be understood that the invention may be embodied otherwise without departing from such principles.

What is claimed:

1. An exhaust manifold reactor assembly for an internal combustion engine comprising a reactor casing having a generally hollow longitudinal cylindrical configuration, inlet means communicating said casing with an exhaust port of said internal combustion engine, outlet means communicating said casing with the exhaust pipe of said internal combustion engine exhaust system, a core having a generally cylindrical configuration inserted in said reactor casing generally concentrically therewith, insulating material between said casing and said core, first mounting means fixedly connecting said core to said casing in at least one location, and second mounting means connecting said core to said casing in another location, said second mounting means being configured to enable relative sliding movement between said core and said casing in directions longitudinally of said casing, said second mounting means between said reactor casing and said core comprising a bolt and a nut, said bolt being formed with two flange portions, a support member including a portion defining through said support member a slot through which said bolt extends, said portion of said support member defining said slot being interposed between said two flange portions of said bolt.

2. An exhaust manifold reactor assembly according to claim 1, defined by said casing with a pair of longitudinal ends, wherein said first mounting means between said reactor casing and said core is arranged longitudinally of said reactor substantially equidistantly between said longitudinal ends, and wherein said second mounting means is arranged longitudinally of said reactor at a location nonequidistant from said longitudinal ends.

3. An exhaust manifold reactor assembly according to claim 1, wherein at least one of said two flange portions of said bolt is welded to said bolt, and wherein the other flange portion is formed integrally with said bolt.

4. An exhaust manifold reactor assembly according to claim 1, wherein said first mounting means between said reactor casing and said core includes a bolt and a nut, and wherein said bolt is welded to said core.

5. An exhaust manifold reactor assembly according to claim 1, wherein said first and second mounting means both include a bolt and a nut, and wherein both said nuts are welded to said reactor casing.

6. A reactor assembly according to claim 5 wherein said first and second mounting means both include a bolt and a nut, said assembly further including an insert fixedly attached to said reactor casing with both said nuts being welded to said insert.

7. An exhaust manifold reactor assembly according to claim 5, wherein said bolt and said nut are welded to each other.

8. A reactor assembly according to claim 1 wherein said first and second mounting means both include a nut and bolt mounting said core to said casing, and a core support member welded to said core through which said bolts extend.

9. A reactor assembly according to claim 1 wherein said second mounting means includes support means affixed to said core including a portion defining through said support means a slot extending longitudinally of said casing, and connection means extending through said slot engaged between said casing and said support members, said connection means being slidable longitudinally of said slot relative to said portion defining said slot.

* * * * *